US007293330B2

(12) United States Patent
Guip et al.

(10) Patent No.: US 7,293,330 B2
(45) Date of Patent: Nov. 13, 2007

(54) TUBULAR HANDLE FOR A MANUALLY GUIDED IMPLEMENT

(75) Inventors: Andreas Guip, Waiblingen (DE); Johannes Menzel, Wernau (DE); Helmut Schlessmann, Prüm (DE); Ralf-Rainer Kemmler, Schwaikheim (DE); Harald Decker, Korb (DE); Günter Wolf, Oppenweiler (DE)

(73) Assignee: Andreas Stihl AG & Co. KG (DE)

( * ) Notice: Subject to any disclaimer, the term of this patent is extended or adjusted under 35 U.S.C. 154(b) by 80 days.

(21) Appl. No.: 11/011,710

(22) Filed: Dec. 14, 2004

(65) Prior Publication Data

US 2005/0138776 A1 Jun. 30, 2005

(30) Foreign Application Priority Data

Dec. 24, 2003 (DE) ..... 103 61 295

(51) Int. Cl.
*B25G 3/32* (2006.01)

(52) U.S. Cl. ..... 16/422; 16/437; 16/DIG. 41

(58) Field of Classification Search ..... 16/422, 16/430, 431, 436, 437, DIG. 40, DIG. 41; 15/143.1, 144.1–144.4, 145, 229.2, 246, 15/235.8; 294/58, 57; 30/210, 216, 381–386; 29/894.1, 894, 450, 521–523, 34 R; 74/502, 74/543, 551.1, 551.9, 505; 403/24, 384, 403/393; D8/70; D12/18; D15/17
See application file for complete search history.

(56) References Cited

U.S. PATENT DOCUMENTS 2,552,917 A * 5/1951 Becker ..... 220/787
2,629,624 A * 2/1953 Nelles ..... 294/57
3,136,574 A * 6/1964 Pasquale ..... 294/54.5
3,534,432 A * 10/1970 Davies et al. ..... 16/437
3,728,793 A * 4/1973 Makinson et al. ..... 30/383
4,108,456 A * 8/1978 Woelffer et al. ..... 280/47.371
4,141,143 A * 2/1979 Hirschkoff et al. ..... 30/381
4,202,096 A * 5/1980 Nagashima ..... 30/381
D261,357 S * 10/1981 Doonan ..... D8/499
4,630,372 A * 12/1986 Nagashima ..... 30/381
4,693,006 A * 9/1987 Wehle ..... 30/383
4,817,291 A * 4/1989 Stehle ..... 30/381
4,912,848 A * 4/1990 Bidanset ..... 30/383
4,958,483 A * 9/1990 Heismann ..... 56/17.5
5,112,175 A * 5/1992 Wilkening ..... 411/372.5
5,245,757 A * 9/1993 Weissert et al. ..... 30/383
5,623,999 A * 4/1997 Linsbauer et al. ..... 173/170

(Continued)

FOREIGN PATENT DOCUMENTS

DE 3523146 A * 1/1987

(Continued)

*Primary Examiner*—Chuck Y. Mah
(74) *Attorney, Agent, or Firm*—Robert W. Becker; Robert W. Becker & Associates

(57) ABSTRACT

A tubular handle for a manually guided implement, especially a power chain saw or the like, is provided. The handle has an essentially circular cross-section and at least one mounting portion for fixing the handle to the implement. In the area of the mounting portion, the circular cross-section is flattened to form an at least approximately planar abutment portion, beyond which a circular cross-sectional portion is retained. The abutment portion is provided for fixing the tubular handle to the implement.

18 Claims, 7 Drawing Sheets

U.S. PATENT DOCUMENTS 7,219,433 B2 * 5/2007 Gorenflo et al. ..... 30/383

FOREIGN PATENT DOCUMENTS

DE 4137187 A1 * 5/1992
DE 19522218 A1 * 1/1996
DE 19937887 A1 * 2/2001
JP 06155335 A * 6/1994
JP 11048203 A * 2/1999

* cited by examiner

TUBULAR HANDLE FOR A MANUALLY GUIDED IMPLEMENT

BACKGROUND OF THE INVENTION

The present invention relates to a tubular handle for a manually guided implement, especially a power chain saw or the like, with an essentially circular cross section and with at least one mounting portion for fixing the tubular handle to the implement.

Manually guided implements, such as chain saws or the like, are provided with a tubular handle that is mounted on the implement for carrying and guiding the latter. During operation, for example of a power chain saw, the latter is guided with two hands, with one hand grasping a rear handle that is secured to the housing, and with the front tubular handle of the power chain saw being held and guided by the other hand. During operation of the power chain saw, considerable holding forces can occur at the tubular handle.

For the securement of the tubular handle to the implement, the tubular handle is provided with at least one mounting portion, whereby the tubular handle can, for example, be screwed to the housing of the implement. To absorb the operating forces at the screw mounting, the circular cross section is flattened in the mounting portion such that an essentially flat, double-walled cross section results. The two flat cross-sectional portions that rest against one another are in this connection pierced by one or more screw holes and have extending therethrough respective mounting screws that are guided through the corresponding screw hole.

A mounting portion that is flattened in this manner is provided, especially transverse to its plane, with only a low rigidity or bearing strength. The high degree of deformation of the material of the tube leads, during the manufacturing process, to a considerable flow of material. In the transition region between the deformed and nondeformed cross section of the tube, cracks or splits can result that adversely affect the bearing strength.

It is therefore an object of the present invention to further improve a tubular handle of the aforementioned general type in such a way that the bearing strength is increased in the region of the mounting portion.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
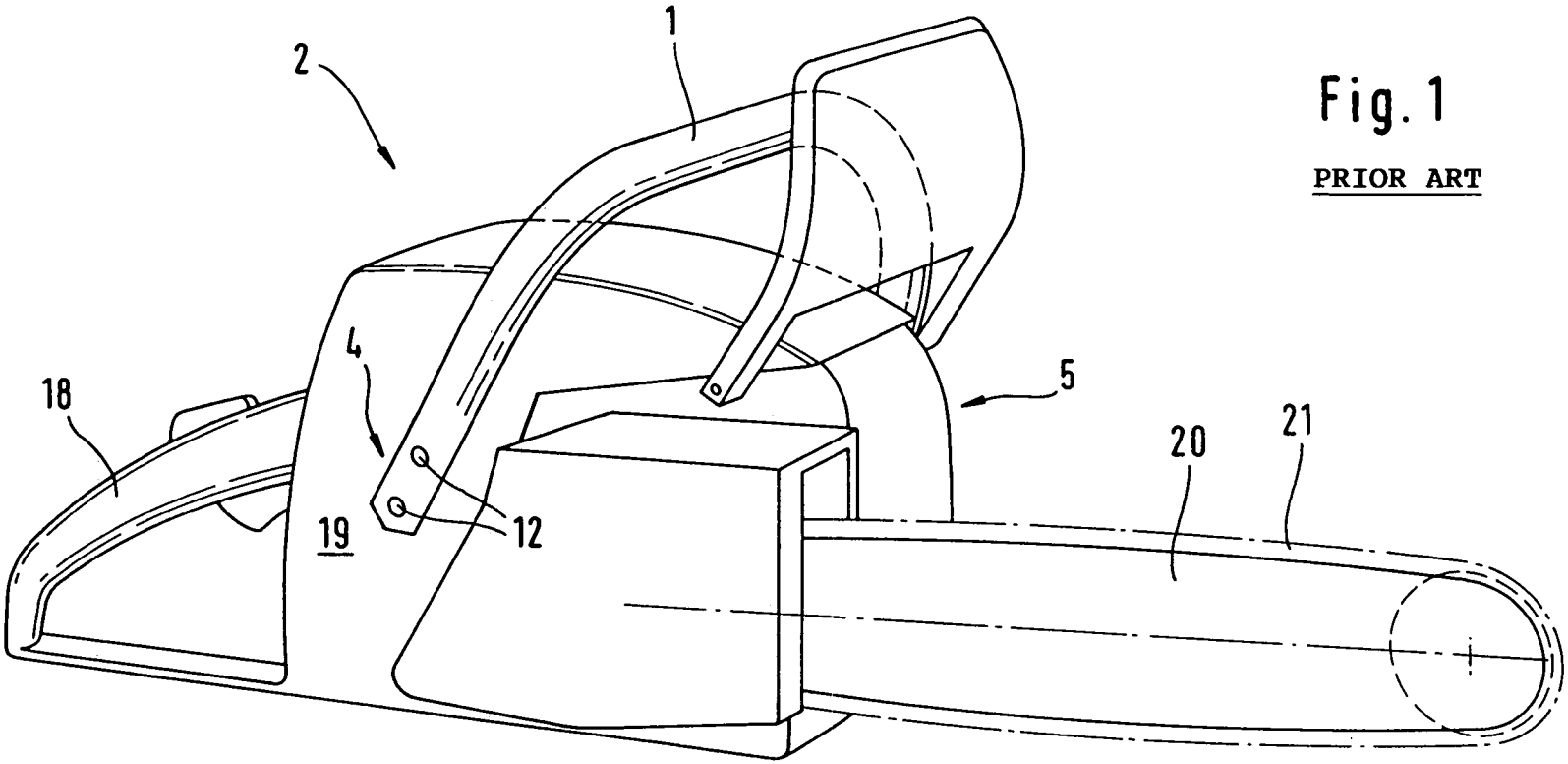
Fig. 1 PRIOR ART
FIG. 1 is a perspective illustration of a manually guided implement, by way of example of a power chain saw, having a tubular handle according to the state of the art.

The present application proposes a tubular handle, the circular cross section of which, in the region of the mounting portion, is flattened to form an at least approximately planar abutment portion, whereby beyond the abutment portion a circular cross-sectional portion is retained. In this connection, the flattened abutment portion is provided for the securement of the tubular handle to the implement. The flattening of the cross section on one side leads to a flat or laminar engagement of the tubular handle against the implement, with such abutment providing a good transfer of forces that occur. Only a slight deformation of the cross section is necessary, thereby reducing the stress on the material during the deformation process. The circular cross-sectional portion that is retained leads, in conjunction with the flattened abutment portion, to a relatively high surface moment of inertia about all main axes, as a consequence of which a high rigidity and a high bearing strength result in all directions of stress or loading. Due to the securement of the tubular handle to the implement merely via the flat abutment surface, the circular cross-sectional portion that is retained is free of screwing or fastening forces. A cross-sectional deformation that reduces the bearing strength under operating loads is avoided.

Pursuant to an advantageous further development, the flattened abutment portion merges via a rounded section with the adjoining cross-sectional portion. An excessive material deformation is avoided in this region. The rounded portion contributes to the stiffening or reinforcement of the cross section.

Pursuant to one expedient embodiment, provided across from the planar abutment portion is a further abutment portion that is disposed in particular parallel thereto. Between the two abutment portions, the circular cross-sectional portion is retained. The supporting cross-section of the tubular handle is altered only slightly. There results the possibility of a two-sided securement relative to the cross section. In particular, a U-shaped holding bracket can be provided that spans the tubular handle in the region of the two oppositely disposed abutment portions. The two planar abutment portions form a positive securement against rotation. With a securement to the two oppositely disposed abutment portions, there results a central introduction of force with a double-shear screw connection. In addition to the appropriate tubular handle portion, the screw connection is also subjected to slight stress.

Pursuant to one expedient embodiment, adjoining both sides of the flattened abutment portion are two side legs that are disposed approximately parallel to one another. In this connection, the side legs are provided in particular with a radius of curvature that is considerably greater than a radius of the circular cross-sectional portion. There results in this region an approximately square or rectangular cross-sectional portion having a large enclosed surface accompanied by a high rigidity in strength. The curvature of the side legs exerts an effect that supports the cross-sectional shape and avoids a bulging transverse to the plane of the wall.

Pursuant to one advantageous embodiment, the circular cross-sectional portion in the mounting portion extends over a cross-sectional angle in the range of at least approximately 180° to approximately 270°. In this angle range, on the one hand the abutment portion is adequately large for a flat or laminar engagement. On the other hand, the circular cross-sectional portion is adequately large to exert its support effect, which is dictated by its shape.

The mounting portion is expediently produced by stamping of the circular cross section. The tubular handle can be manufactured from a tubular semi finished product having a circular cross section in a cost effective and rapid manner, and with little material stress. An expedient suitable material for the tubular handle is an aluminum alloy, and in particular AlZn4, 5Mg1. A good deformability with low tendency to tear and a high material strength at low weight are provided, even at high degrees of deformation.

Pursuant to an advantageous further development, the abutment portion has a screw hole, and the oppositely disposed circular cross-sectional portion has an insertion hole for the introduction of a mounting screw. The mounting portion is easy to attach, and possibly also detach, on and from the implement. In the mounted state, a head of the mounting screw is disposed within the tube cross section, and is protected against damage and contamination. On the whole, there results a space-saving manner of construction.

In this connection, there is expediently inserted on the inside of the tubular handle an insert that rests against the abutment portion and has a screw hole. The insert contributes to the reinforcement of the abutment portion. Force peaks during the screwing or tightening operation are uniformly distributed via the insert to the abutment portion. Localized load increases are avoided.

The abutment portion and the insert advantageously respectively have at least two screw holes that are associated with one another. The corresponding mounting portion is fixed in an appropriately spatially good manner, whereby even with, for example, an unintentionally loosened screw connection, an adequately high holding force remains.

In the region of the screw hole, the insert is expediently provided, on its side that faces the abutment portion, with a concave recess. Upon application of the screwing force, the insert can spring or deflect in an elastic manner. The screw connection can appropriately be provided with an elastic prestress, whereby the screw forces are retained even at high vibrational stresses. Burrs or the like on the inside of the screw holes of the tubular handle can extend into the recess without obstructing a flat abutment of the insert against the abutment portion.

Pursuant to one expedient embodiment, a plug, which is provided in particular with elastically resilient latching tongues, is provided for the insertion hole. This prevents penetration of dirt into the insertion hole, and hence into the interior of the tubular handle. The screw connection is reliably protected against corrosion. In conjunction with the resilient latching tongues there results an easy ability to assemble.

Pursuant to an advantageous variation, a threaded portion, and in particular a blind rivet nut, is provided in the abutment portion. A screwing can be effected from the side of the implement into the corresponding threaded portion, in other words from the outside toward the inside. An insertion hole that weakens the cross section of the tubular handle is not required.

Further specific features of the present application will be described in detail subsequently.

DESCRIPTION OF SPECIFIC EMBODIMENTS

Referring now to the drawings in detail, FIG. 1, in a perspective schematic illustration, shows an implement 2, by way of example a power chain saw. The implement 2 is provided with a motor portion 19, of the rear side of which is connected a rear handle 18. The motor portion 19 is spanned above and to the side by a tubular handle 1, whereby the implement 2 can be held and guided with one hand on the rear handle 18 and the other hand on the tubular handle 1. On that end that is opposite the rear handle 18, the power chain saw is provided with a guide bar 20 about which circulates a cutting chain 21. When the guide bar 20 with the cutting chain 21 penetrates into material that is to be cut, correspondingly high manual forces are to applied, in particular via the tubular handle 1. Reaction forces from the cutting process can increase the forces at the tubular handle 1.

The tubular handle 1 shown in FIG. 1 is embodied pursuant to the state of the art, and is screwed to the motor portion 19 at two attachment or mounting portions 4, 5. The tubular handle 1 has an essentially circular cross section that in the region of the mounting portions 4, 5 is flattened in such a way that the opposing tubular walls mate in a flat manner. In the region, two mounting screws 12 respectively extend through for fastening the tubular handle 1 to the implement 2.

Figure 2:
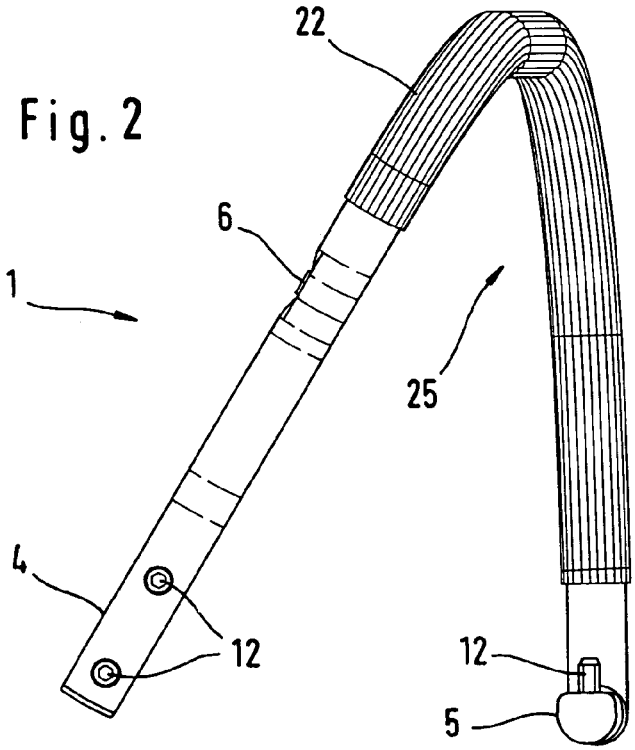
FIG. 2 is a side view of one exemplary embodiment of a tubular handle for the securement to the power chain saw of FIG. 1, and includes mounting portions that are flattened on one side.

The side view of FIG. 2 shows one inventively embodied tubular handle 1 for the fixing on the implement of FIG. 1. A corresponding tubular handle 1 can also be provided for comparable implements 2, such as cut-off machines or the like. The tubular handle 1 of FIG. 2 is covered, in a grip area 25, with a hose or sleeve 22 of polymeric material that, for a good gripping ability, is provided with a structured surface. A total of three attachment or mounting portions 4, 5, 6 are provided beyond the grip area 25. In this connection, attachment or mounting screws 12 that extend through are shown in the two mounting portions 4, 5.

Figure 3:
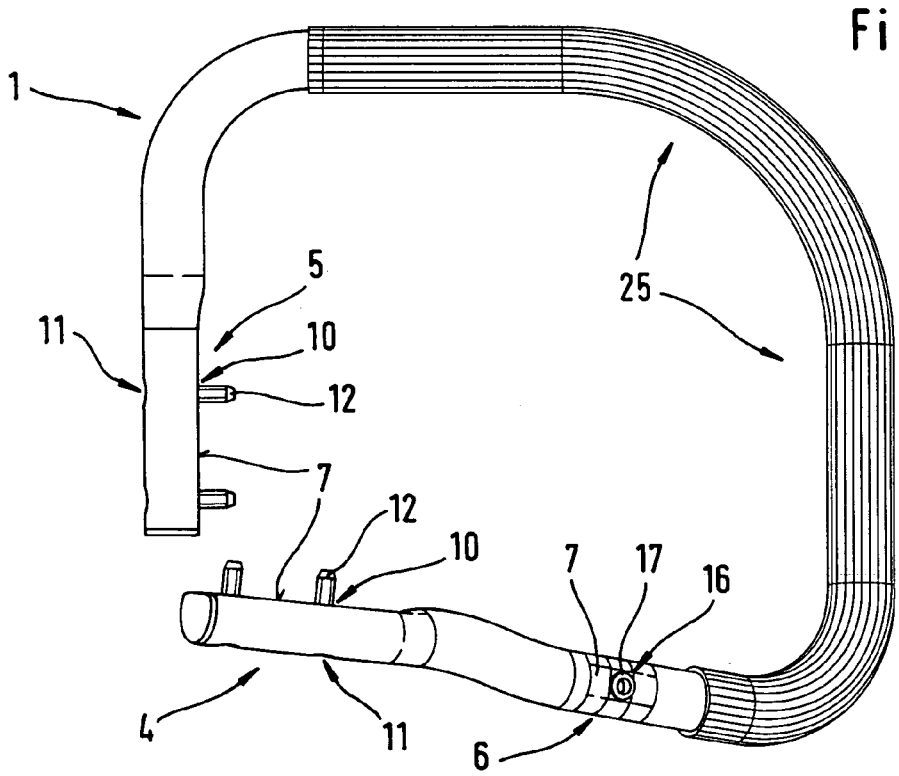
FIG. 3 is a front view of the tubular handle of FIG. 2 with mounting screws extended therethrough, or with a blind rivet nut inserted in one abutment portion.

The front view of FIG. 3 shows the tubular handle 1 of FIG. 2. Especially in the grip area 25, the tubular handle 1 has an essentially circular cross section that via stamping is flattened on one side in the region of the mounting portions 4, 5, 6 accompanied by the formation of essentially planar abutment portions 7. The two mounting portions 4, 5 are each provided, in their abutment portion 7, with two screw holes 10 that are axially spaced from one another; a respective insertion hole 11 is respectively associated across from each screw hole 10. Mounting screws 12 are inserted through the insertion holes 11 and project from the inside outwardly beyond the abutment portion 7. Non-illustrated heads of the mounting screws 12 are disposed within the tubular handle 1.

The further mounting portion 6, in the region of the pertaining flat or planar abutment portion 7, is provided with a threaded portion 16 that in the illustrated embodiment is embodied as a riveted-in blind rivet nut 17, and is provided for receiving a mounting screw 12 that is to be screwed inwardly from the outside, an anti-vibration element having a threaded portion, or the like. The threaded portion 16 can also be formed, for example, by a stamped-in, inwardly flanged hole having formed therein an internal thread.

Figure 4:
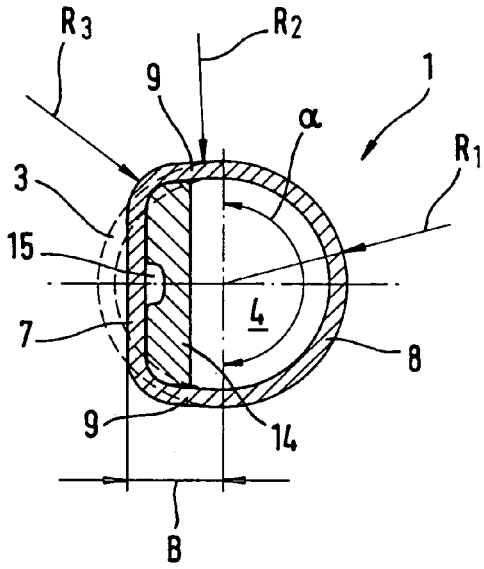
FIG. 4 is a cross-sectional illustration of the tubular handle of FIGS. 2 and 3 in the region of a mounting portion having disposed within it an insert.

The cross-sectional illustration of FIG. 4 shows the tubular handle 1 of FIGS. 2 and 3 in the region of the mounting portion 4. In the grip area 25 (FIGS. 2, 3), a circular cross-section 3 of the tubular handle 1 is illustrated by dashed lines. The cross section of the mounting portion 4 shown here is produced by stamping of the circular cross-section 3 in such a way that an at least approximately planar abutment portion 7 is formed that merges, via rounded portions having a radius $R_3$, into two adjoining side legs 9 that are disposed approximately parallel to one another. Adjoining the side legs 9 is a circular cross-sectional portion 8 that in the illustrated embodiment extends over a cross-sectional angle $\alpha$ of approximately 180°.

During transformation of the circular cross section 3 into the cross-sectional shape shown here, the circular cross-sectional portion 8 retains its shape in conformity with the circular cross section 3. In this connection, the circular cross section 3 and the circular cross sectional portion 8 have the same radius $R_1$. The two side legs 9 are only approximately planar, and in comparison to the $R_1$ of the circular cross sections 3, 8 are curved with a relatively large radius of curvature $R_2$. In the illustrated embodiment, the radius of curvature $R_2$ is approximately four times the radius $R_1$. The two side legs 9, including the thickness of the abutment portion 7, have a width B that is approximately ¾ of the radius $R_1$, as a result of which a cross-sectional transformation can essentially be effected by bending while avoiding linear compression or elongation.

Disposed on the inside of the mounting portion 4 is an insert 14 that on the inner side rests in a flat manner against the abutment portion 7. On that side of the insert 14 that faces the abutment portion 7, a groove-shaped recess 15 extends centrally, and in an axial direction, over the entire length of the insert 14. The recess 15 is thus also provided in the region of the screw holes 10, 13 (see FIG. 5).

Figure 5:
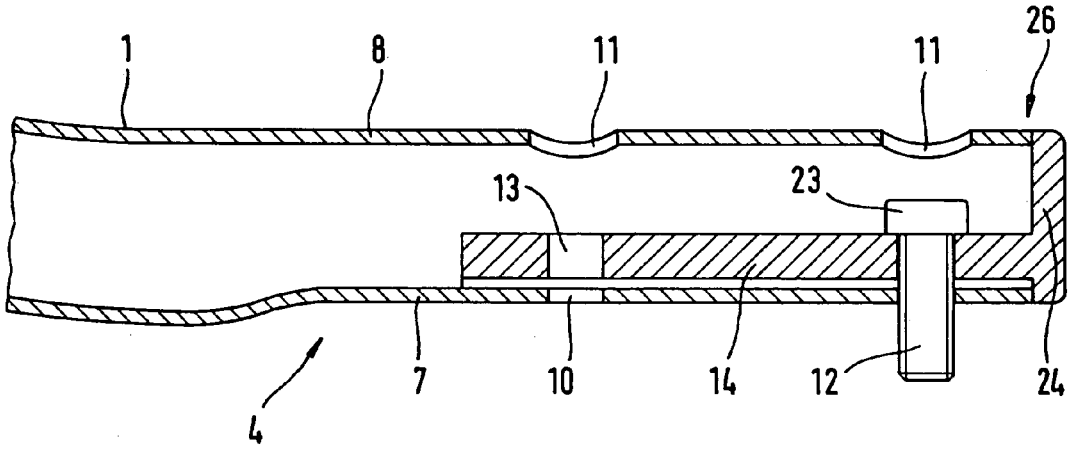
FIG. 5 is a longitudinal cross-sectional illustration of the arrangement of FIG. 4.

The longitudinal cross-sectional illustration of FIG. 5 shows the arrangement of FIG. 4. The insert 14 is inserted into the interior from an end 26 of the tubular handle 1, whereby a cover portion 24 that is formed on the insert 14 rests against the end face of the tubular handle 1. The cover portion 24 thereby acts as a closure for the tubular handle 1, as well as a depth positioning stop.

The abutment portion 7 is interrupted by two screw holes 10 that are spaced axially from one another and which have respectively associated therewith two screw holes 13 of the insert 14 that are associated with one another at the same spacing. Coaxial to the screw holes 10, 13, the circular cross-sectional portion 8 that is opposite the abutment portion 7 is provided with insertion holes 11. In the illustrated embodiment, only one mounting screw 12 is shown that extends outwardly from the inside through the corresponding screw holes 10, 13. The mounting screw 12, together with its head 23, was previously guided through the insertion hole 11. The head 23 of the mounting screw 12 rests upon the insert 14. When the tubular handle 1 is screwed to the implement 2 (FIG. 1) the fixing of the tubular handle 1 is effected merely in the region of the abutment portion 7, with the forces at the mounting screws 12 being introduced via the insert 14 and the abutment portion 7 into the tubular handle 1. The circular cross-sectional portion 8 is not directly subjected to the screwing forces.

Figure 6:
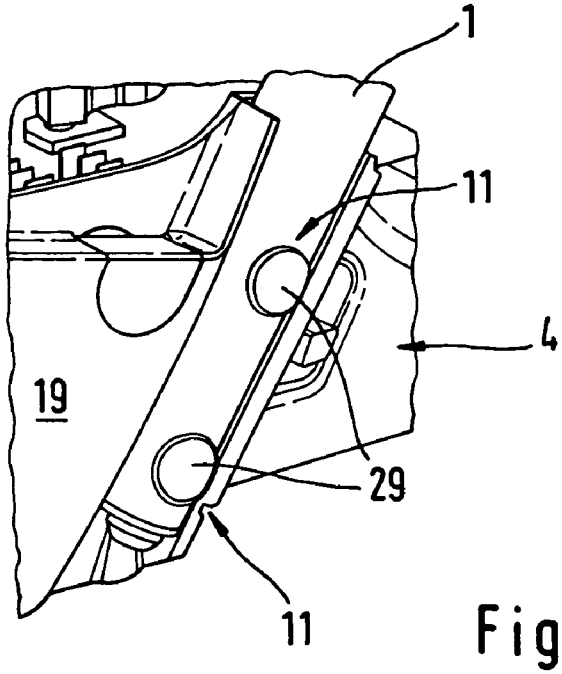
FIG. 6 is a perspective detailed view of the mounting portion of FIGS. 4 and 5 in the mounted state with insertion holes protected by plugs.

The perspective detailed view of FIG. 6 shows the mounting portion 4 of FIGS. 4 and 5 in the mounted state. The mounting portion 4 of the tubular handle 1 is screwed to the motor portion 19, whereby the two insertions holes 11 are respectively covered via a plug 29.

Figure 7:
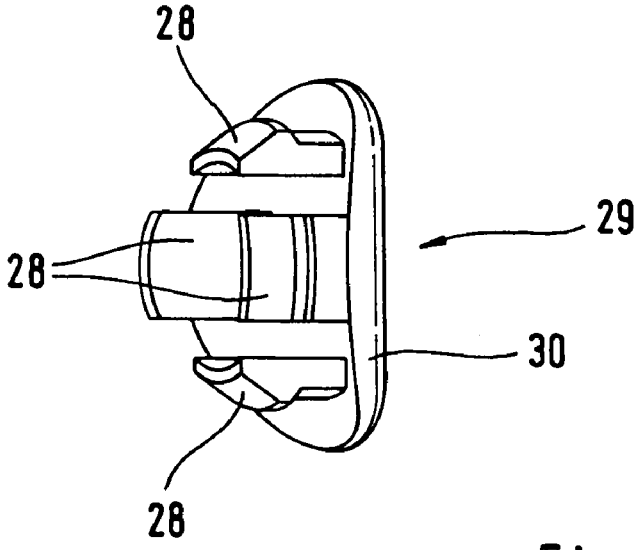
FIG. 7 is a perspective detailed view of the plug of FIG. 6.

The perspective detailed view of FIG. 7 shows the plug 29 of FIG. 6. The plug 29 is provided on the other side with a cover portion 30, the contour of which is adapted to the round cross-sectional portion 8 (FIG. 4). To secure the plug 29 to the insertion hole 11 (FIG. 6), in the illustrated embodiment a total of four elastically resilient latching tongues 28 are provided that can be inserted from the outer side of the tube into the respective insertion hole 11, thereby leading to a latching or arresting of the plug 29.

Figure 8:
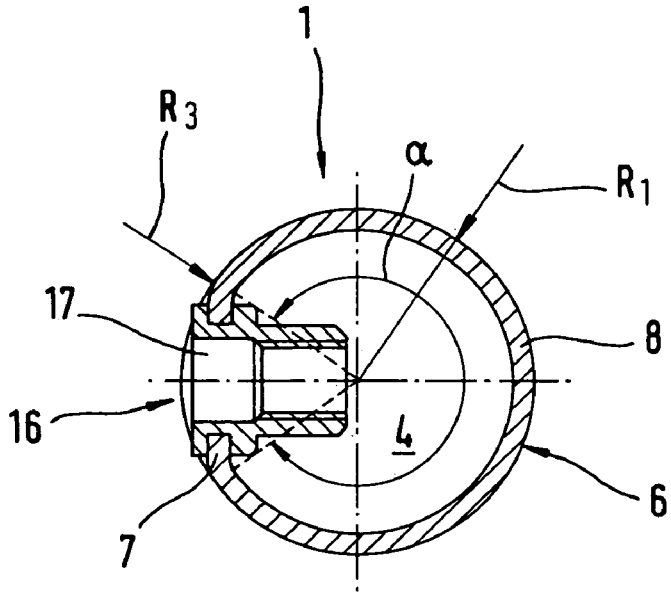
FIG. 8 is a cross-sectional illustration of the tubular handle of FIGS. 2 and 3 in the region of a further mounting portion having a blind rivet nut inserted therein.

The cross-sectional illustration of FIG. 8 shows the tubular handle 1 in the region of the mounting portion 6 of FIGS. 2 and 3. The abutment portion 7 merges on both sides, via a respective edge radius $R_3$, directly into the remaining circular cross-sectional portion 8. The radius $R_1$ of the cross-sectional portion 8 corresponds to the radius $R_1$ of the cross-sectional portion 8 as well as of the circular cross-sectional portion 3 of FIG. 4. With the cross-sectional configuration shown in FIG. 8, the circular cross-sectional portion 8 extends over a cross-sectional angle $\alpha$ of approximately 270°. Riveted into the abutment portion 7 is a blind rivet nut 17 into which a suitable threaded component can be screwed inwardly from the outside. The oppositely disposed circular cross-sectional portion 8 is, in this connection, embodied without an insertion hole 11 as in FIG. 5.

Figure 9:
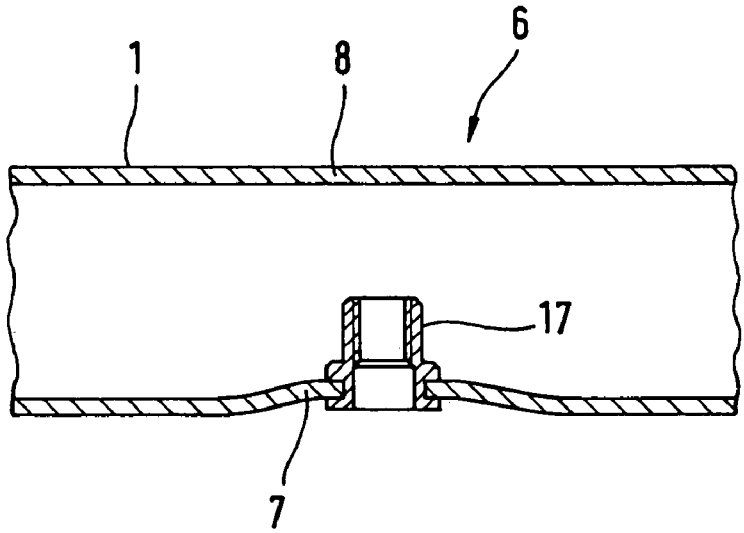
FIG. 9 is a longitudinal cross-sectional illustration of the arrangement of FIG. 8.

The longitudinal cross-sectional illustration of FIG. 9 shows the arrangement of FIG. 8, according to which the mounting portion 6, in the axial direction, extends over a short region such that only a single blind rivet nut 17 is riveted into the abutment portion 7. Depending upon the application, however, it would also be possible to provide an embodiment of the abutment portion 7 having two or more blind rivet nuts 17, that are axially spaced relative to one another, in conformity with the arrangement of the screw holes 10, 13 of FIG. 5.

The mounting portion 6 shown here can also be embodied with screw holes 10, 13, as well as with insertion holes 11, in conformity with FIG. 5. The embodiment of the mounting portion 5 (FIGS. 2, 3) corresponds to the illustration of FIGS. 4 and 5. The mounting portions 4, 5 can, if necessary, also be embodied in conformity with FIGS. 8 and 9.

Figure 10:
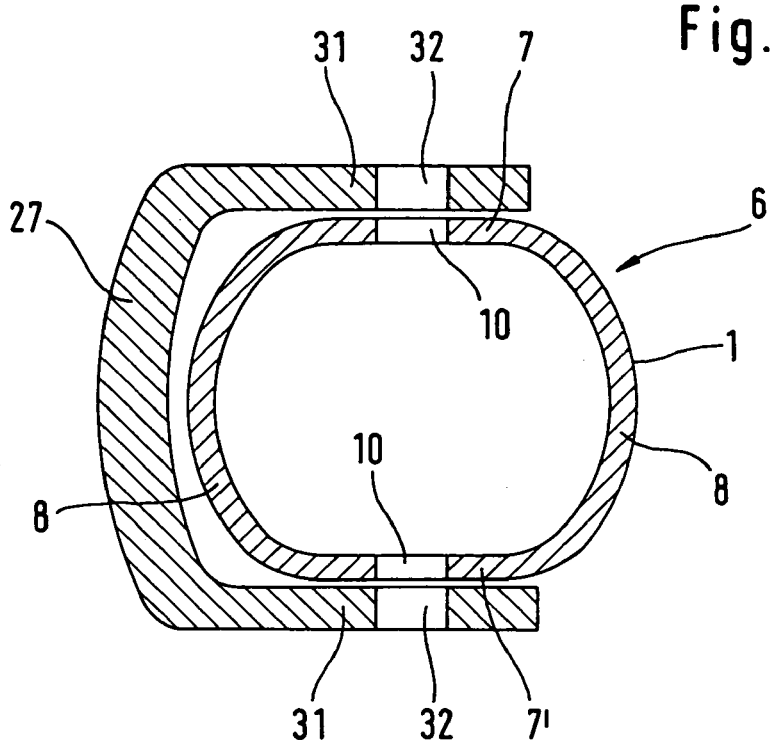
FIG. 10 is a cross-sectional illustration of a variation of the mounting portion of FIGS. 8 and 9 having two oppositely disposed abutment portions that are disposed parallel to one another, and a holding bracket.

The schematic cross-sectional illustration of FIG. 10 shows a variation of the mounting portion 6 of FIGS. 8 and 9, according to which, opposite the planar abutment portion 7, there is provided a further abutment portion 7' that is disposed parallel to the abutment portion 7. Respective remaining round cross-sectional portions 8 extend between the two abutment portions 7, 7'. A respective screw hole 10 is provided in the two planar abutment portions 7, 7'. In the region of the mounting portion 6, the tubular handle 1 is embraced on the outside by a U-shaped holding bracket 27, which is provided with two legs 31 that extend parallel to one another. The two legs 31 are disposed flat, with a slight amount of play, against the respectively adjacent abutment portion 7, 7'. Provided in the legs 31 are screw holes 32 that are aligned with the screw holes 10 in the abutment portion 7, 7' For the attachment, for example, a mounting screw 12 (FIG. 11) can be inserted through the screw holes 10, 32. Similarly, an embodiment can be advantageous where a respective blind rivet nut 17 according to FIG. 9 can be inserted into the screw holes 10, whereby two individual mounting screws 12 (FIG. 11) can be utilized.

Figure 11:
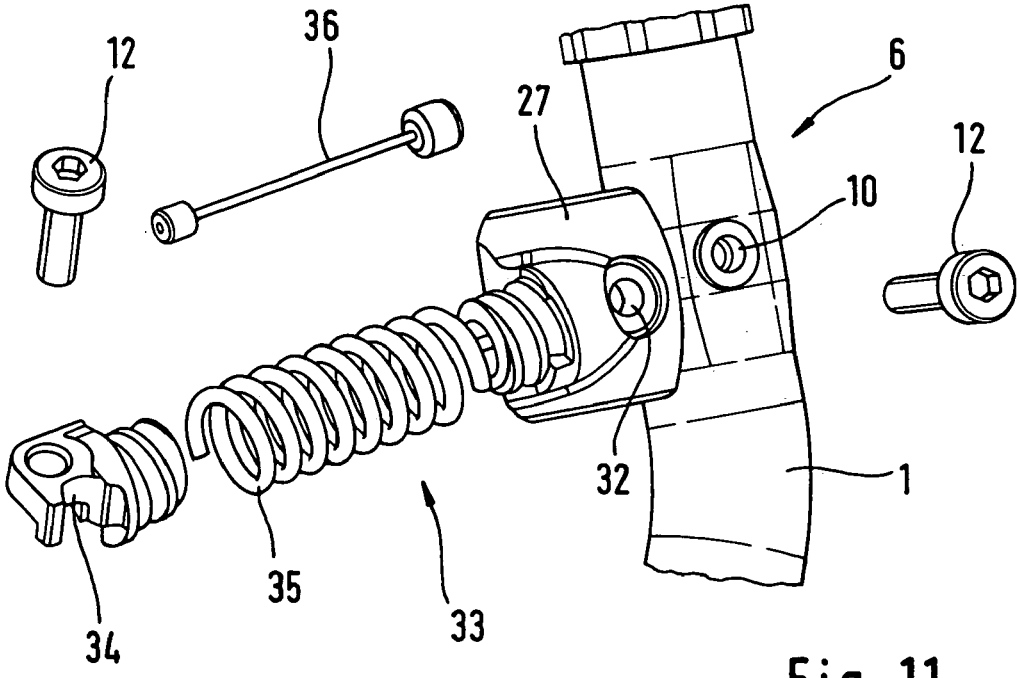
FIG. 11 is an exploded illustration of one embodiment of the arrangement of FIG. 10 having an anti vibration element.

The exploded illustration of FIG. 11 shows an embodiment of the tubular handle 1 having the mounting portion 6 of FIG. 10, as well as an anti-vibration element 33. The anti-vibration element includes the holding bracket 27, the mounting portion 34, the coil spring 35, and a separation protection means 36. The holding bracket 27 and the mounting portion 34 each have helically shaped attachment sections via which they can be screwed into the two opposite ends of the coil spring 35. In the mounted state, disposed coaxially relative to the coil spring 35 is the separation protection means 36 in the form of a flexible steel wire or cable, by means of which the holding bracket 27 and the mounting portion 34 are secured relative to one another, even if the coil spring 35 breaks. A respective mounting screw 12 is provided for the securement of the holding bracket 27 on the mounting portion 6 and for the securement of the mounting portion 34 on a suitable location of the implement 2 (FIG. 1) respectively.

Figure 12:
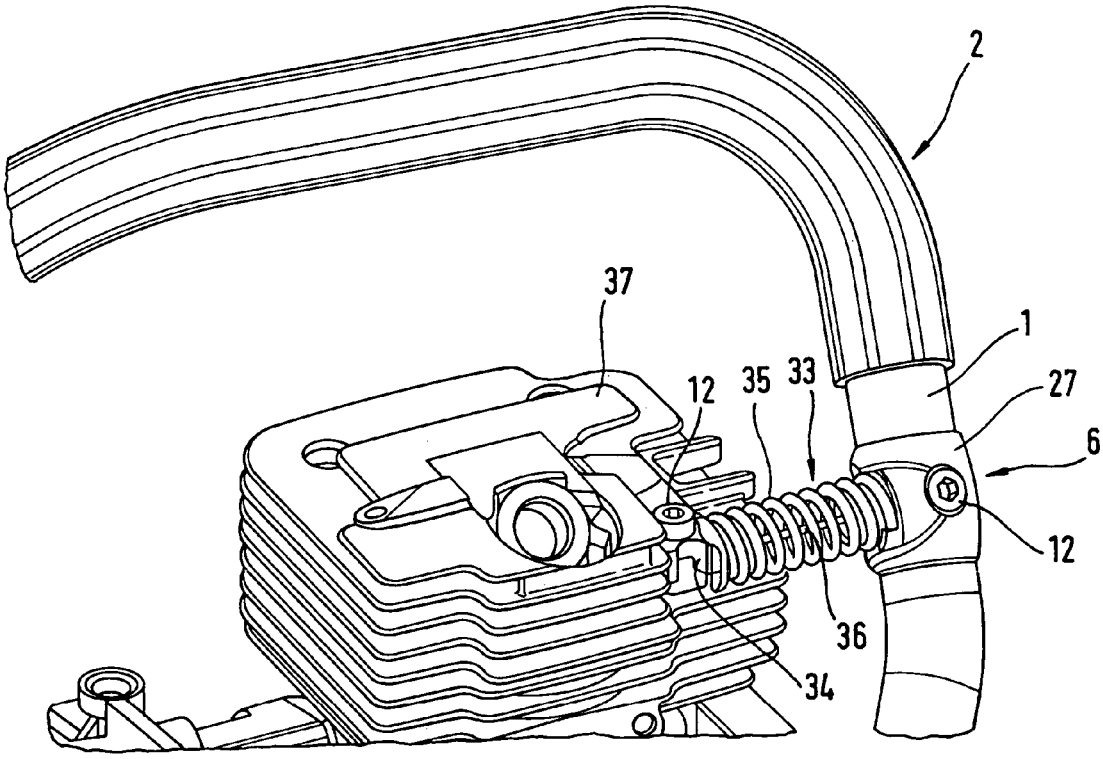
FIG. 12 is a perspective illustration of the arrangement of FIG. 11 showing a connection of the tubular handle to a cylinder via an anti vibration element.

The perspective detailed view of FIG. 12 shows the implement 2 of FIG. 1 in the region of a cylinder 37 of a drive motor. The mounting portion 6 of the tubular handle 1 is secured to the cylinder 37 via the anti-vibration element 33 in an elastically oscillating and dampening manner. In this connection, a mounting screw 12 is screwed through the holding bracket 27 and the mounting portion 6 of the tubular handle 1. The mounting portion 34 is screwed to the cylinder 37 via a further mounting screw 12. The separation protection means 36 is disposed within and coaxially relative to the coil spring 35.

In the illustrated embodiment, the tubular handle 1 of FIGS. 2 to 12 is produced from an aluminum alloy, whereby AlZ4, 5Mg1 is selected as the material. It would also be possible to provide a tube made of steel or polymeric material.

The specification incorporates by reference the disclosure of German priority document 103 61 295.5 filed Dec. 24, 2003.

The present invention is, of course, in no way restricted to the specific disclosure of the specification and drawings, but also encompasses any modifications within the scope of the appended claims.

The invention claimed is:

1. A handle for a manually guided implement, comprising:

a tubular member having a grip area and at least one mounting portion for fixing the tubular handle to the implement, wherein said grip area has an essentially circular cross-section, wherein, in the area of the at least one mounting portion, said tubular member comprises a mounting portion cross-section having a flattened cross-sectional portion that forms an at least approximately planar abutment portion for fixing said tubular handle to the implement, wherein said mounting portion cross-section further has a circular cross-sectional portion, wherein said abutment portion is provided with a screw hole, wherein diamerically across therefrom said circular cross-sectional portion is provided with an insertion hole for the introduction of a mounting screw, wherein an insert is disposed on an inner side of said tubular handle, and wherein said insert rests against said abutment portion and is provided with at least one screw hole.

2. A tubular handle according to claim 1, wherein said abutment portion of said mounting portion cross-section merges via rounded portions having a radius into adjoining portions of said mounting prtion cross-section.

3. A tubular handle according to claim 2, wherein said mounting portion cross-section has a further abutment portion that is disposed diametrically across from said planar abutment portion.

4. A tubular handle according to claim 3, wherein said further abutment portion is disposed parallel to said planar abutment portion.

5. A tubular handle according to claim 3, wherein in the region of said two abutment portions a holding bracket is attached to and spans a portion of said tubular handle.

6. A tubular handle according to claim 5, wherein said holding bracket is U-shaped.

7. A tubular handle according to claim 1, wherein two side legs of said mounting portion cross-section adjoin opposite sides of said abutment portion, and wherein said two side legs are disposed approximately parallel to one another.

8. A tubular handle according to claim 7, wherein in comparison to a radius of said circular cross-sectional portion said side legs have a distinctly greater radius of curvature.

9. A tubular handle according to claim 7, wherein in said at least one mounting portion said circular cross-sectional portion extends over a cross-sectional angle in the range of at least approximately 180° to approximately 270°.

10. A tubular handle according to claim 1, wherein said at least one mounting portion is produced by a stamping of said circular cross-section.

11. A tubular handle according to claim 1, wherein said tubular handle is made of an aluminum alloy.

12. A tubular handle according to claim 11, wherein said aluminum alloy is AlZn4, 5Mg1.

13. A tubular handle according to claim 1, wherein said abutment portion and said insert are respectively provided with two screw holes that are associated with one another.

14. A tubular handle according to claim 1, wherein in the region of said at least one screw hole said insert, on a side thereof that faces said abutment portion, is provided with a concave recess.

15. A tubular handle according to claim 1, wherein a plug is provided for said insertion hole.

16. A tubular handle according to claim 15, wherein said plug is provided with elastically resilient latching tongues.

17. A tubular handle according to claim 1, wherein a threaded portion is provided in said abutment portion.

18. A tubular handle according to claim 17, wherein said threaded portion is a blind rivet nut.

* * * * *